United States Patent [19]

Thoman

[11] Patent Number: 4,920,894

[45] Date of Patent: May 1, 1990

[54] MODULAR ANTI-SPIN UNIT FOR RAILWAY CAR DOOR

[75] Inventor: Mell R. Thoman, Omaha, Nebr.

[73] Assignee: Railcar Specialties, Inc., Alsip, Ill.

[21] Appl. No.: 402,079

[22] Filed: Aug. 31, 1989

[51] Int. Cl.[5] ..... B61D 17/00

[52] U.S. Cl. ..... 105/378; 49/220

[58] Field of Search ..... 105/310.1, 355, 375, 105/378; 49/218, 219, 220

[56] References Cited

U.S. PATENT DOCUMENTS 3,555,731 1/1971 Ross ..... 49/220

3,660,938 5/1972 Ross ..... 49/220

*Primary Examiner*—Andres Kashnikow

*Assistant Examiner*—Mike Cunningham

*Attorney, Agent, or Firm*—Wallenstein, Wagner & Hattis, Ltd.

[57] ABSTRACT

A modular add-on unit provides (14) anti-spin protection for a gear-operated locking system (13) of plug-in railway freight car doors (12). The unit has an input shaft (26) with a handle (36) attached thereto, and an output shaft (42) with a recess (40) therein configured for direct engagement with industry standard door shafts. An anti-spin mechanism (24) disposed within a housing (17) couples the two shafts together, and the housing is attached to the outer surface (42) of the door, preferably by welding.

7 Claims, 6 Drawing Sheets

MODULAR ANTI-SPIN UNIT FOR RAILWAY CAR DOOR

TECHNICAL FIELD

The technical field of the invention is the railway freight car art, and in particular plug-in door locking systems therefor.

BACKGROUND OF THE INVENTION

Compression-sealing "plug-in" doors are commonly provided for railway freight cars where an ambient sealing of the interior is desired, a typical case in point being refrigerated railway cars. Such doors often have a gear-operated door frame engaging mechanism coupled to be driven by rotation of a handle affixed to a drive shaft which operates the mechanism to alternatively sealingly close the door, or alternatively to unlock it. These mechanisms are inherently powerful, and when the door is compressingly sealed, a significant reverse torque is imparted to the handle as a result of the compression forces. Such a reverse torque can also arise from a number of other factors, such as a shifted load of product inside the car leaning against the door, or the force of the door's own weight when the car is tilted to lean outward. Handles are routinely secured against counter-rotation in the door-opening direction by handle locking mechanisms of one sort or another. To open the door, however, the handle lock must be released. If, at that time, or at any other time during rotation of the handle in the door-opening direction, the operator should lose control of the handle, the handle will frequently spin, resulting in a highly dangerous condition to the operator, and occasionally resulting in broken bones.

Anti-spin devices are now becoming known which will automatically arrest such dangerous spinning, and which can readily be incorporated into the interior of the railway car door at the time of manufacture, or which may alternatively be retro-fitted by partial disassembly of the door to give access to the existing mechanism to permit installation. Because of the high number of railway cars already in use, a less expensive retro-fit system for gear-operated doors would be economically advantageous.

SUMMARY OF THE INVENTION

A modular self-contained anti-spin mechanism is provided within a housing attachable to the exterior of a railway freight car door. The modular attachment includes a handle rotatably affixed to the anti-spin mechanism, the mechanism in turn having a coupling element facing an aperture in the housing and configured to engage with the industry-standard square door shaft coupled to the door frame engaging and locking mechanism.

To install the module the existing door handle is removed, the module is emplaced against the door with the coupling element engaging the door shaft, and the housing is thereafter permanently secured to the door, preferably by welding fillets. The necessity for disassembly of the door and installing an anti-spinning mechanism in the drive train therein is completely eliminated. Other features and advantages of the invention will be evident by reference to the drawings, specifications, and claims.

DESCRIPTION OF INVENTION

Figure 1:
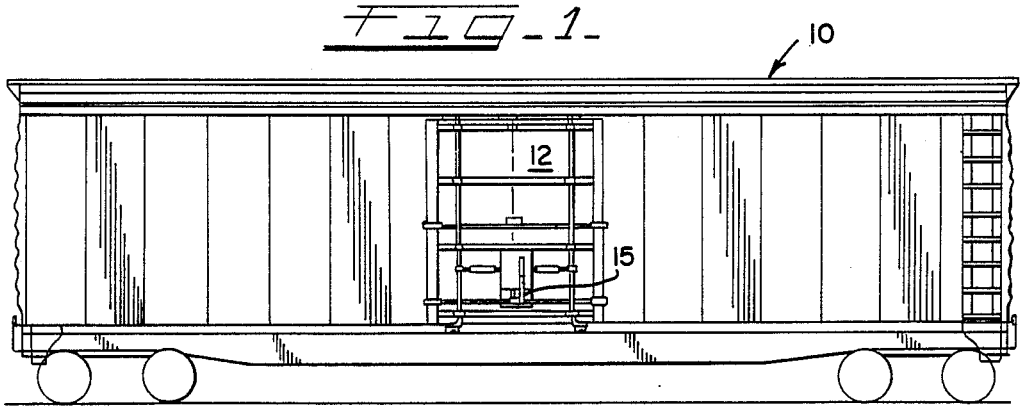
FIG. 1 is a side elevational view of a railway car provided with a plug-in sealing side door.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

Figure 2:
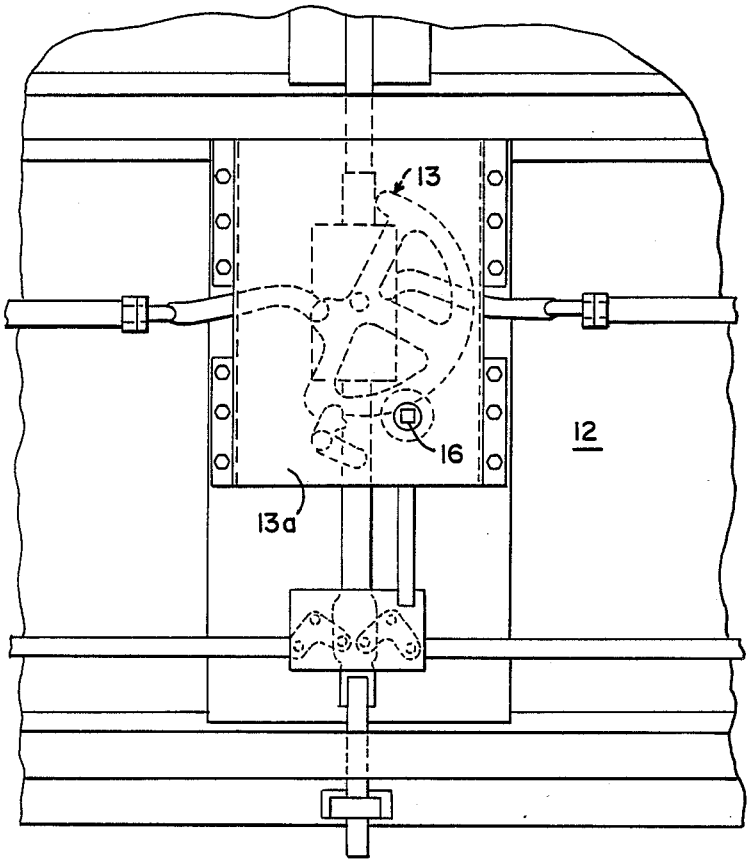
FIG. 2 is a front elevation view of a portion of the door of the railway car shown in FIG. 1 with the handle removed.
Figure 5:
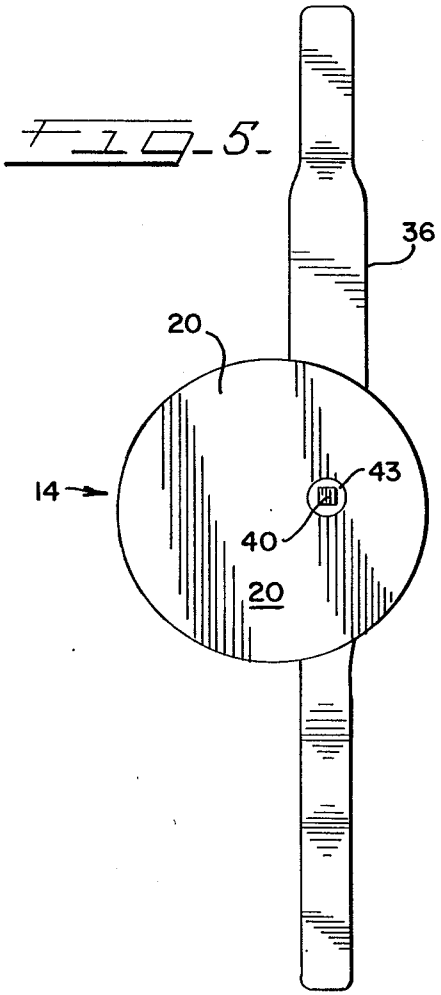
FIG. 5 is a rear elevational view of the module as viewed along line 5—5 of FIG. 4.
Figure 6:
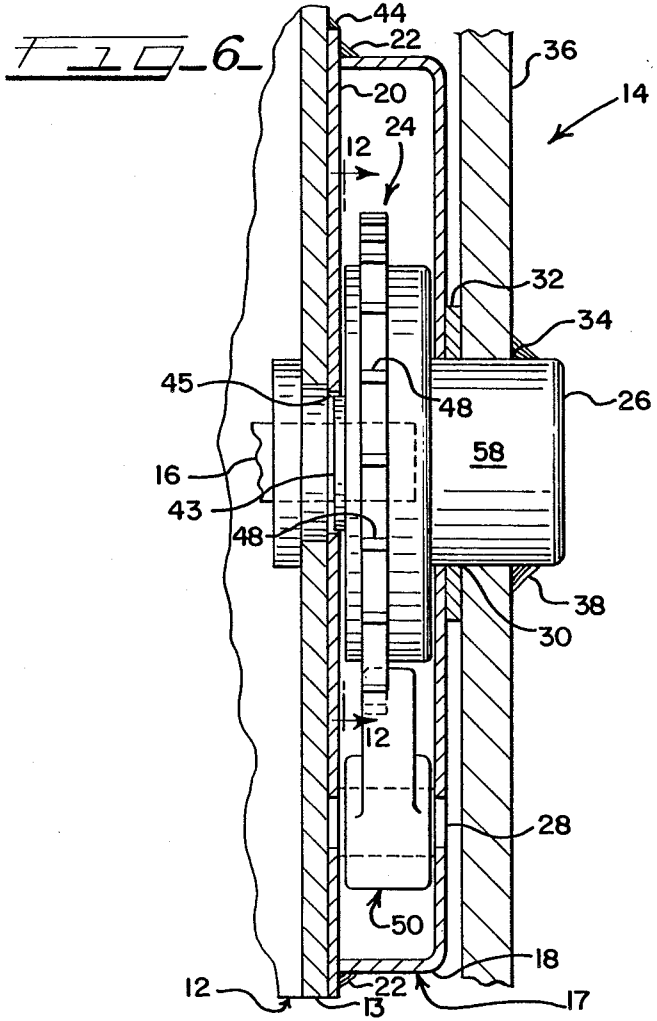
FIG. 6 is a partially cutaway cross-section view of the central region shown in FIG. 4.

Referring now to the drawings, and in particular initially to FIGS. 1–5, a railroad car 10, configured with a plug-in type door 12 carrying an interior operating gear mechanism 13 (hereinafter referred to as locking mechanism) shown in dotted outline in FIG. 2 and covered by an access plate 13*a* is normally actuated by rotation of a handle 15 affixed to an outwardly extending industry-standard square-ended drive shaft 16. The accessory anti-spin module 14 (FIG. 3) of the present invention comprises a generally cylindrical housing 17 having a cover plate 18 welded to a base plate 20 by welding fillets 22 (see also FIG. 6). An anti-spin mechanism 24 (FIG. 8) is disposed within the housing 17 and has a cylindrical pinion hub 26 extending forwardly from the outer face 28 of the housing 17 through a closely fitting housing passage 30. A spacing washer 32 is emplaced over the pinion hub 26 and in confronting contact with the outer wall 28 of the housing 18. An elongated handle 36 having a circular aperture 34 centrally located therein is emplaced over the pinion hub 26 to be in contact with the outer face of the washer 32, and is secured to the pinion hub by welding fillets 38.

Figure 3:
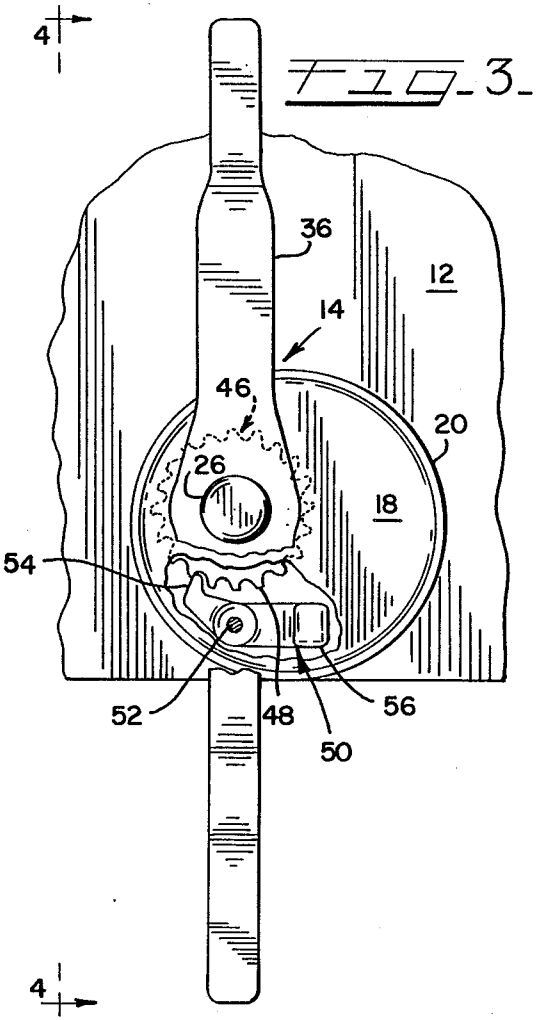
FIG. 3 is a partially cut-away front elevation of a modular anti-spin device emplaced on a railway car door.
Figure 4:
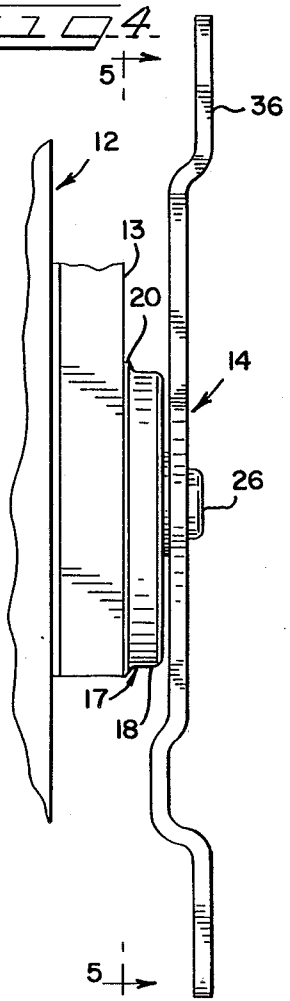
FIG. 4 is a side view of a module type shown in FIG. 3.

Coaxially disposed at the opposite end of the anti-spin mechanism 24 is a square passage 40 (FIG. 8) provided in a sleeve flange 42 (to be discussed subsequently), the passage being configured to engagingly accept the industry-standard square end of the door actuating shaft 16. A cylindrical outer end 43 of the sleeve flange 42 is held loosely captive in a passage 45 in the base plate 20. The assembled module 14 is emplaced over the door shaft 16 after removal of the handle 15 so that the shaft engagingly enters the square sleeve flange passage 40, the module then being slid inward along the shaft until the base plate 20 is in contact with the access plate 13*a*. The module 14 is then secured in place, preferably by welding fillets 44 (FIG. 6) peripherally disposed around the base plate 20. Rotation of the handle 36 in a clockwise direction as seen in FIG. 3 operates the door locking mechanism 13 to sealingly close the door, and operation of the handle in the opposite direction will open the door.

Associated with the anti-spin mechanism 24 is a ratchet 46 having peripherally disposed ratchet teeth 48 configured for one-way engagement with a gravity-operated pawl 50. The pawl 50 is mounted for rotation about a pawl pin 52 affixed to the housing 17, and has one end 54 thereof configured for one-way engagement with the teeth 48 of the ratchet wheel 46. The opposite end of the pawl has an enlarged region 56 providing significant additional weight to cause the pawl 50 to rotate clockwise under the force of gravity. Thus, as seen in FIG. 3, the ratchet wheel 46 may only rotate in the clockwise (door-opening) direction. As will be discussed next, rotation of the handle 15 in the door-opening direction will urge the door shaft 16, coupled to the door frame engaging mechanism 13 to open the door 12, and rotation in the opposite direction will actuate the door shaft to close it.

Figure 8:
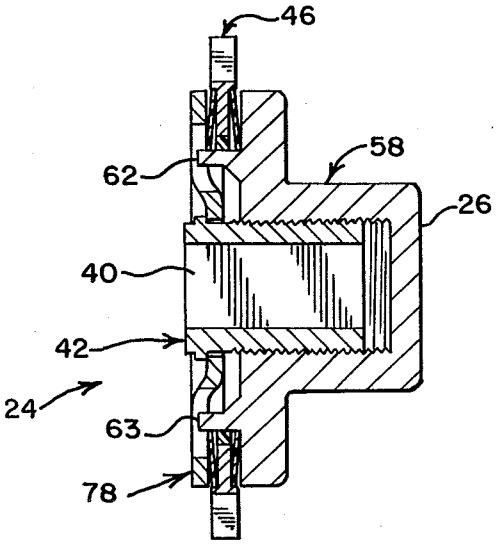
FIG. 8 is a cross-section view of the anti-spin mechanism of FIG. 7 in assembled form.
Figure 7:
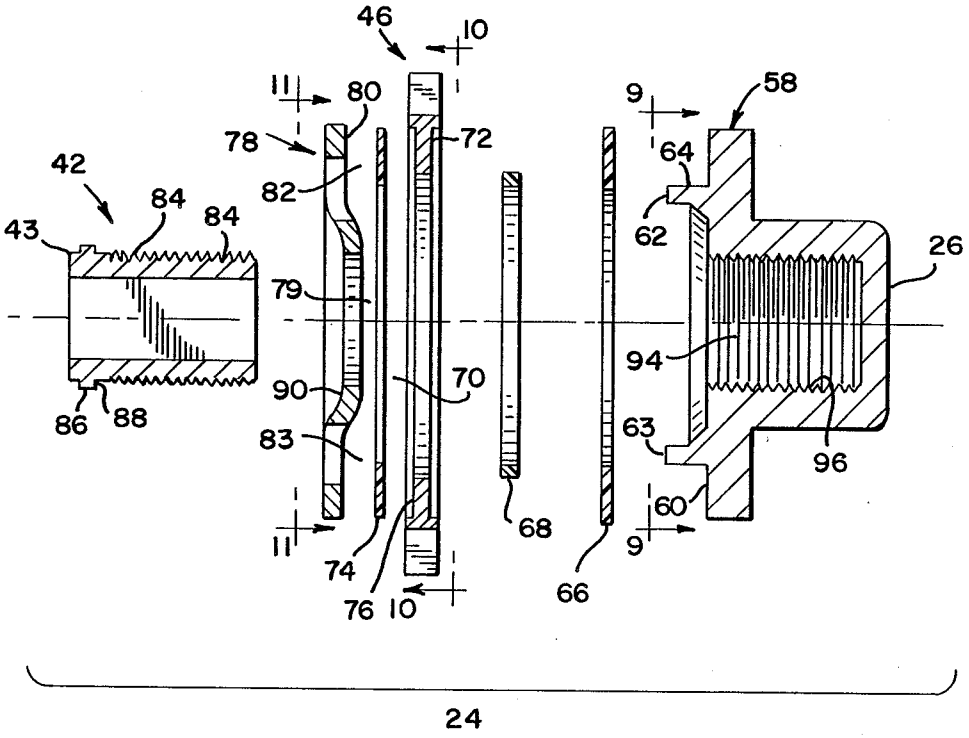
FIG. 7 is an exploded view of the anti-spin mechanism shown in FIG. 6.
Figure 9:
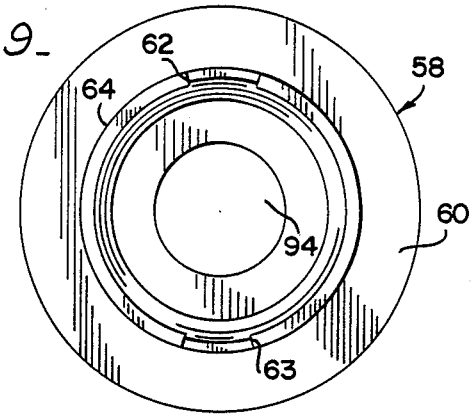
FIG. 9 is a front elevation of a pinion of the anti-spin mechanism of FIGS. 7 and 8.
Figure 10:
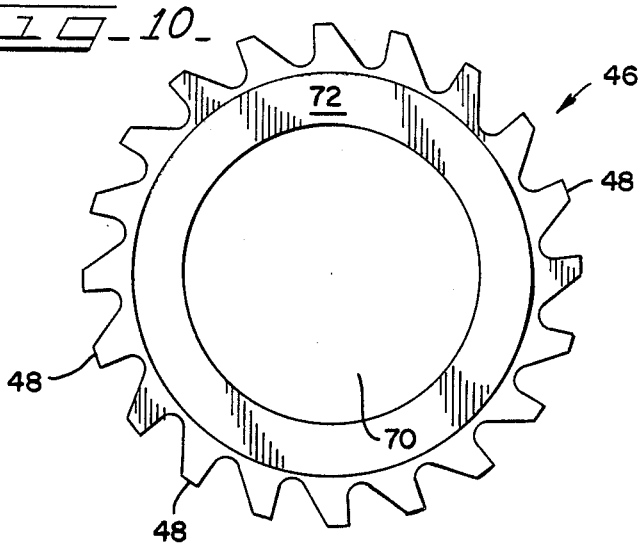
FIG. 10 is a front elevation of a ratchet gear of the anti-spin mechanism of FIGS. 7 and 8.
Figure 11:
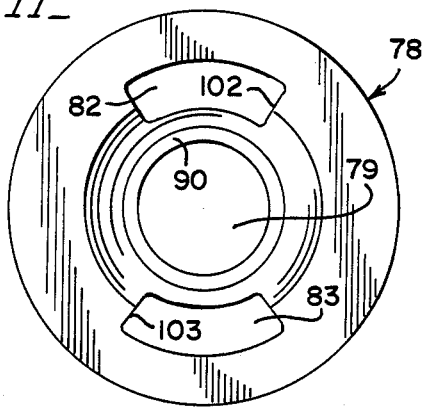
FIG. 11 is a front elevation of a flange of the anti-spin mechanism of FIGS. 7 and 8.

Referring now to in particular to FIGS. 7—13, and initially in particular to FIGS. 7 and 8, the anti-spin mechanism includes a pinion ring 58 having the previously mentioned forwardly extending hub 26. The pinion ring 58 further has a rearwardly facing annular engaging face 60, and a pair of extension dogs 62, 63 rearwardly extending as prolongations of a short cylindrical rearwardly extending annularly disposed support shoulder 64. A first annular clutch disk 66 is nestingly emplaced over the support shoulder 64, as is a narrowly annular anti-chafing washer 68, which in turn nestingly receives a central bore 70 the ratchet 46, the ratchet having a recessed annular engaging face 72 configured for confronting nesting engagement with the clutch disk 66.

A second clutch disk 74 is emplaced over the opposite face of the ratchet 46, similarly being emplaced over a disk-receiving annular recess 76 on the opposite face of the ratchet. A pressure plate 78 is configured in the form of a radially extending flange having a central bore 79 passing therethrough, and has an annular engaging face 80 and a pair of diametrically-disposed arcuate cutouts 82, 83 passing therethrough. The pressure plate 78 is emplaced over the assembly so that the engaging face 80 engages the clutch disk 74, and so that the dogs 62, 63 pass through the cutouts 82, 83, respectively.

The previously mentioned sleeve flange 42 is a generally cylindrical member having an external right-hand thread 84 cut along most of the length thereof. The sleeve flange 42 has flange 86 disposed close to a cylindrical sleeve end 43 and extending radially outward to present a flange face 88 towards the pressure plate 78. The pressure plate 78 has a central annular planar portion presenting a face 90 configured for compression engagement with the flange face 88 of the sleeve flange 86. The central bore 79 in the pressure plate 78 is configured to accept the threaded portion 84 of the flange sleeve 86.

Figure 12:
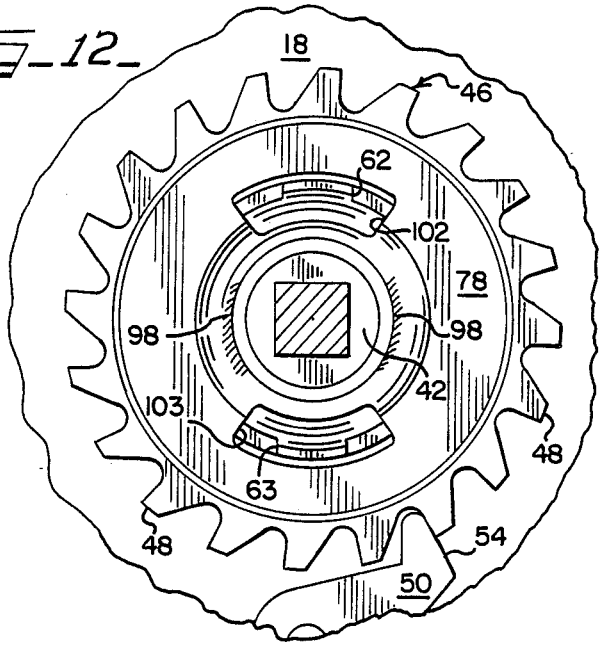
FIG. 12 is a rear elevation view of the assembled anti-spin mechanism in the engaged condition.

The pinion ring 58 has a central passage 94 therein configured with a right-hand thread 96 for rotating engagement with the threads 84 of the sleeve flange 86. The sleeve flange 86 is inserted through the bore 79 of the pressure plate 78 and is screwed into the passage 94 of the pinion ring 58. The sleeve 42 is advanced with the dogs 62, 63 held centered in their respective cutouts 82, 83 as shown in FIG. 12. A terminal portion of the advance occurs when the flange 86 compressingly forces the pressure plate 78, clutch disk 74, ratchet 46, clutch disc 66 and pinion ring 58 into compressing engagement. The flange 86 of the sleeve 42 is then permanently secured to the pressure plate 78 by welding fillets 98 as shown in FIG. 12.

FIG. 8 shows the completed assembly; however, the configuration shown therein has the clutch in the loose disengaged condition. The clutch discs 66, 74 and the ring are preferably made of synthetic plastic material, such as that marketed under the trademark "NYLON" or "DELRIN 500" by the DuPont Company. All remaining elements are preferably of steel.

Figure 13:
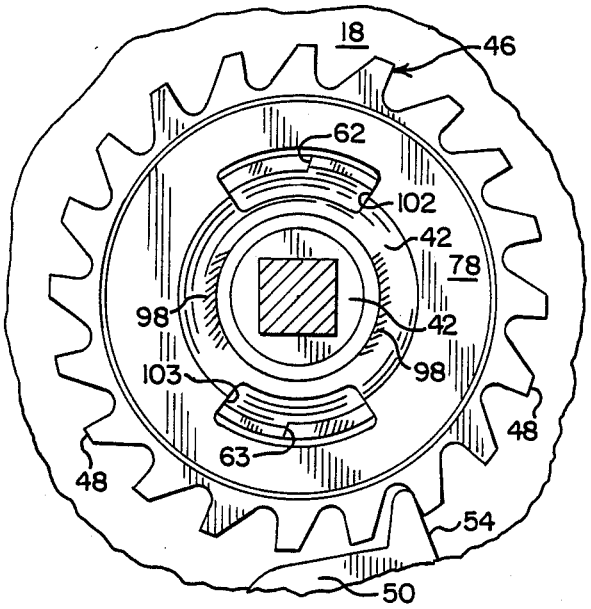
FIG. 13 is a rear elevational view of the anti-spin mechanism shown in FIG. 12 in the disengaged condition.

It will be recalled that the anti-spin device 24 is to serve as a coupling for closing of the door by clockwise rotation of the handle 36, and thus the pinion ring 58, and further to act so that with the door 12 compressingly sealed, the device will prevent rotation of the handle in the counter-clockwise door-opening direction under the influence of counterclockwise torques from the door engaging mechanism 13 acting on the door shaft 16. Thus, considering first the situation with the door fully closed and the mechanism 13 (FIG. 2) supplying a counter-clockwise torque to the door shaft 16, this torque will cause the sleeve 42 to rotate clockwise as seen in FIGS. 12 and 13. Clockwise rotation of the sleeve 42 will therefore advance it into the pinion 50, thus compressing the clutch disks 74, 66, and effectively coupling all elements by friction to the ratchet wheel 46. The ratchet wheel 46, however, because of the engagement with the pawl 50 cannot rotate in this direction. Therefore, any movement is immediately arrested.

Still considering the door shaft as "alive" in this sense, rotation of the handle 36, and thus the pinion 58 in the door-opening direction, i.e., the same direction that the shaft 16 is attempting to urge the structure, will result in a rotation of the pinion ring 58 to advance outward along the threaded sleeve 42. This acts to relieve the compressing force of the pressure plate 78, in particular releasing the drag force created by the stationary ratchet 46, with the result that the live shaft 16 will be allowed to rotate in the door-opening direction. If the operator should release the handle 36 at any time, the live shaft 16 will immediately rotate the sleeve 46 to advance into the pinion 58, again reinstating the previous high-drag arresting condition on the system. The handle thus cannot spin out of control if accidentally released during door-opening conditions when the door shaft 16 is alive.

Finally, when the door shaft 16 is "dead", i.e., producing no further torque in the door-opening direction, further rotation of the pinion 58 in this direction causes the sleeve 42 and pressure plate 78 to retreat slightly, releasing all clutch pressure, and rotating the pinion dogs 62, 63 into arresting contact with the ends 102, 103, respectively, of the arcuate cutouts 82, 83 of the pressure plate 78 as shown in FIG. 13. The ratchet wheel 46 is now decoupled from the remainder of the system, and further rotation of the pinion 58 in the door-opening direction is coupled directly to the door shaft 16 through the dogs 62, 63.

For door closure, the handle 36, and thus the pinion 58, are rotated in the opposite direction, carrying the dogs 62,63 away from contact with the ends 102, 103 of their arcuate cutouts 82, 83, while at the same time drawing the sleeve 42 unto the pinion 58 and again compressing the elements into frictional engagement. The pinion 58, the sleeve 42, and the ratchet wheel 46 are now all frictionally interconnected, except that now the ratchet wheel is free to rotate, as a result of which the door shaft 16 is rotated clockwise as seen in FIG. 2 to close and seal the plug-type door 12. Here again it will be noted that once the compression forces cause the door shaft 16 to provide a torque in the door-opening direction, release of the handle 36 will not result in handle spin, but will immediately result in the previously described locking engagement of the clutch elements 66, 74, the ratchet 46, and the pawl 50.

While the specific embodiments have been illustrated and described, numerous modifications come to mind without significantly departing from the spirit of the invention and the scope of protection is only limited by the scope of the accompanying claims.

I claim:

1. An anti-spin module for attachment to a railway car plug-in door locking mechanism releasably locking said door responsively to rotation of an actuating shaft having an outer end extending through the outer surface of said door comprising:

a housing having front and rear faces and confrontingly attachable to the outer surface of said door at said rear housing face, said housing having a rear aperture in said rear housing face and a front aperture in said front housing face;

rotatable engagement means for engaging the outer end of said actuating shaft through said rear housing aperture;

an anti-spin mechanism disposed within said housing and coupled to said rotatable engaging means, said anti-spin mechanism including a rotatable input shaft extending through said front housing aperture, brake means for inhibiting torque transmission from said rotatable engaging means to said input shaft in a door-opening direction, coupling means for transmitting torque from said input shaft to said rotatable engagement means in a door-opening direction and a door-closing direction, and automatic release means for substantially releasing said brake means during rotation of said input shaft in said door-closing direction.

2. The anti-spin module of claim 1 including an operating handle attachable to said input shaft.

3. The anti-spin module of claim 1 including an operating handle attached to said input shaft.

4. The anti-spin module of claim 1 mounted to said door and engaging said actuating shaft.

5. The anti-spin module of claim 2 mounted to said door and engaging said actuating shaft.

6. The anti-spin module of claim 3 mounted to said door and engaging said actuating shaft.

7. A railway car comprising:

at least one plug-in door, said door having an outer surface;

a door locking mechanism including an actuating shaft having an outer end extending through the outer surface of said door for releasably locking said door responsively to rotation of said actuating shaft;

a housing having front and rear faces and having said rear housing face confrontingly affixed to said outer surface of said door, said housing having a front aperture passing through said front housing face and a rear aperture extending through said rear housing face acceptingly emplaced around said outer end of said actuating shaft rotatable engagement means disposed within said housing for engaging said outer end of said actuating shaft through said rear housing aperture and in engagement with said actuating shaft;

an anti-spin mechanism disposed within said housing and coupled to said rotatable engaging means, said anti-spin mechanism including a rotatable input shaft extending through said front housing aperture, brake means for inhibiting torque transmission from said rotatable engaging means to said input shaft in a door-opening direction, coupling means for transmitting torque from said input shaft to said rotatable engagement means in a door-opening and a door-closing direction, and automatic release means for substantially releasing said brake means during rotation of said input shaft in said door-closing direction; and an operating handle attached to said input shaft.

* * * * *